United States Patent [19]

Hillman et al.

[11] 4,083,273

[45] Apr. 11, 1978

[54] HOLE PUNCHING METHOD AND APPARATUS

[75] Inventors: Theodore E. Hillman, West Cloquet; Mark D. Belcher, New Brighton, both of Minn.

[73] Assignee: Conwed Corporation, St. Paul, Minn.

[21] Appl. No.: 748,683

[22] Filed: Dec. 8, 1976

[51] Int. Cl.[2] ..... B26F 1/08

[52] U.S. Cl. ..... 83/2; 83/327; 83/660

[58] Field of Search ..... 83/2, 327, 328, 310, 83/660

[56] References Cited

U.S. PATENT DOCUMENTS

| | | | |
|---|---|---|---|
| 3,479,913 | 11/1969 | Goemann et al. | 83/327 X |
| 3,747,447 | 7/1973 | Wisner | 83/327 X |

*Primary Examiner*—J. M. Meister

*Attorney, Agent, or Firm*—Eyre, Mann, Lucas & Just

[57] ABSTRACT

Method and apparatus for punching holes in continuously moving board material are disclosed. The holes may be decorative or functional and are punched so that no or negligible elongation results. The board is continuously moved in a first direction at a first speed and at least one member having pins or other projections thereon is rotated simultaneously about two axes at angular speeds such that the pins contact and punch the board during a portion of the rotation of the member while the speed of the member and the first speed are approximately equal and with the projections being in an essentially predetermined orientation to the board. Since the projections are oriented with respect to the board and are moving at approximately the same speed as the board while they contact and punch the board, there will be no or negligible elongation of the punched holes.

5 Claims, 6 Drawing Figures

HOLE PUNCHING METHOD AND APPARATUS

BACKGROUND OF THE INVENTION

1. Field of the Invention

The invention disclosed herein relates to a method and apparatus for punching holes in continuously moving board material.

2. Description of the Prior Art

Known methods and apparatuses for punching non-elongated holes in board material utilize reciprocating motion. Flat press plates having pins thereon are reciprocated to press the pins into the board while the board is held stationary, the board being moved between each press of the plate. While the holes thus produced are non-elongated, the board is not moved continuously which results in a generally slower operation when compared to a continuously moving board system. Also, a generally more complex system is required to start and stop the motion of the board and to synchronize the board and press motion in a reciprocating press system than in a continually moving board system. U.S. Pat. No. 3,538,797 issued in the name of the assignee herein, discloses a continuous system using a rotating drum with pins mounted thereon. However, the system disclosed in the aforementioned patent, while speeding up the hole punching operation by continuously moving the board, produces holes which are somewhat elongated. In many instances such elongation in the holes is considered aesthetically unsatisfactory. The invention disclosed herein provides for the continuous movement of the board and produces punched board with no or negligible elongation of the holes. Also, additional advantages are realized by the instant invention as will be apparent hereafter.

SUMMARY OF THE INVENTION

The present invention is embodied in and carried out by a method and apparatus for punching holes in continuously moving board material in which the punched holes have no or negligible elongation. The board is continuously moved in a first direction and hole punching means are moved along a first arc to contact the moving board over at least a portion of the arc, the angular speed of the hole punching means and the first speed being chosen such that the speed of the hole punching means is approximately equal to the speed of the board at least during the time that they are in contact, the hole punching means being in a predetermined orientation with respect to the board at least during the time that they are in contact. The hole punching means may be positioned in the predetermined orientation by movement thereof along a second arc.

These and other aspects of the present invention will be more apparent from the following detailed description of the invention when considered in conjunction with the accompanying drawing.

BRIEF DESCRIPTION OF THE DRAWING

The invention is illustrated by way of example in the figures of the accompanying drawing in which like numerals refer to like parts and in which.

DESCRIPTION OF THE PREFERRED EMBODIMENTS

Figure 1:
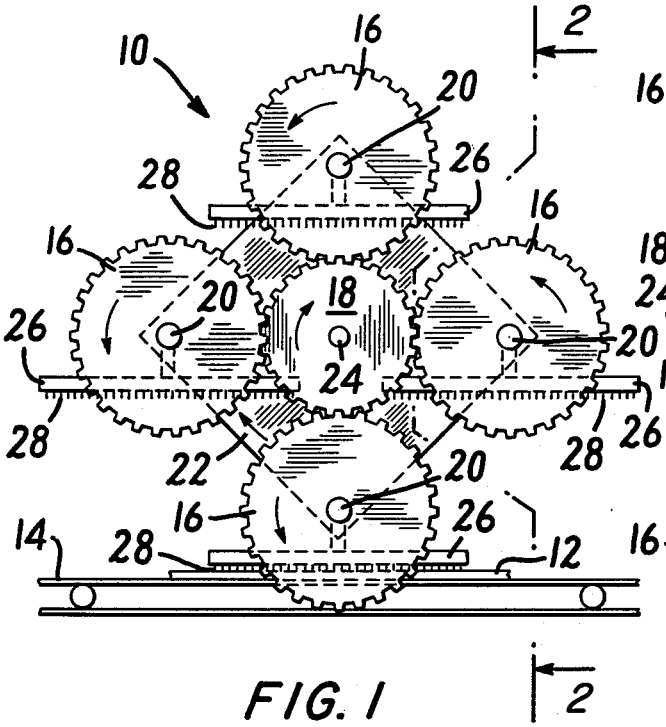
FIG. 1 diagrammatically shows an elevation view of the preferred embodiment of the invention.

In FIG. 1, apparatus 10 for rotating hole punching means while maintaining the hole punching means in the same predetermined orientation relative to continuously moving board 12 is diagrammatically shown. Board 12, advantageously fiber board, is continuously moved in a first direction in a plane normal to that of the figure at a first speed. This may be accomplished by means of conveyor 14. Other apparatuses for moving board 12 will be apparent to those skilled in the art. Planet gears 16 of same diameter are positioned to mesh with sun gear 18 and are spaced equally about the circumference of sun gear 18. The shafts 20 of the planet gears 16 are rigidly secured to the respective planet gear and bearing mounted on plate 22. Shaft 24 is rigidly fixed to sun gear 18 and is restrained (not shown) from rotating except about its own axis. Shaft 24 may be restrained from rotating except about its own axis by connection to, for example, driving means (FIG. 2) as will be described more fully hereinafter. Plate 22 is free to rotate in the plane normal to the plane of board 12 about an axis which lies along shaft 24. Both shaft 24 and plate 22 are driven by means (FIG. 2) about the axis of the shaft at a sun gear to planet gear angular speed ratio of 2.25 to 1. Since the planet and sun gears mesh, rotation of the sun gear 18 about shaft 24 causes the planet gears to rotate about their respective shafts 20. The sun gear to planet gear diameter ratio is 1 to 1.25. Since plate 22 is driven to rotate about an axis along shaft 24, the planet gears rotate about the sun gear. Thus, planet gears 16 rotate about their own axes (shafts 20) as well as about the axis of sun gear 18. The sun gear and plate 22 are rotated in the same direction, shown to be clockwise in FIG. 1. This causes the planet gears to rotate about their own axes (shafts 20) in the opposite direction (counterclockwise).

Rigidly secured to each shaft 20 are respective plates 26, each having a multiplicity of pins 28 thereon. The plates are rigidly secured to the respective shafts to rotate therewith. Accordingly, as the planet gears are rotated about shafts 20, plates 26 are correspondingly rotated. System 10 is aligned so that pins 28 extend normal to the top surface of board 12. Since the planet gears themselves are simultaneously rotated about their own axes (shafts 20) and about the sun gear in opposite directions, the plates 26 always remain in the same relative attitude with respect to the board 12, the aforementioned angular sun gear to planet gear angular speed ratio of 2.25 to 1 and the aforementioned planet gear to sun gear diameter ratio of 1.25 to 1 having been chosen to accomplish this. Although these ratios are not unique to achieve the desired result, they are necessary to each other and are considered to be the most useful ratios.

In operation, boards 12 are continuously moved in a first direction in a first plane at a first speed and plates 26 with pins 28 extending therefrom are rotated and revolved in a second plane normal to the first plane simultaneously about two axes (about shaft 24 and respective shafts 20) in opposite angular directions such that the pins are always normal to the board, the respective axes being positioned such that the arc of the plates 20 about shaft 24 contacts the boards at a tangent thereto, the speed of the boards and plate along the tangent being approximately equal. As plates 26 rotate, pins 28 extending therefrom successively contact the moving boards and punch holes therein. Since the pins are moving at approximately the same speed as the boards when they are in contact, and since the pins are normal to the board during the time of contact, the punched holes have no or negligible elongation.

Figure 2:
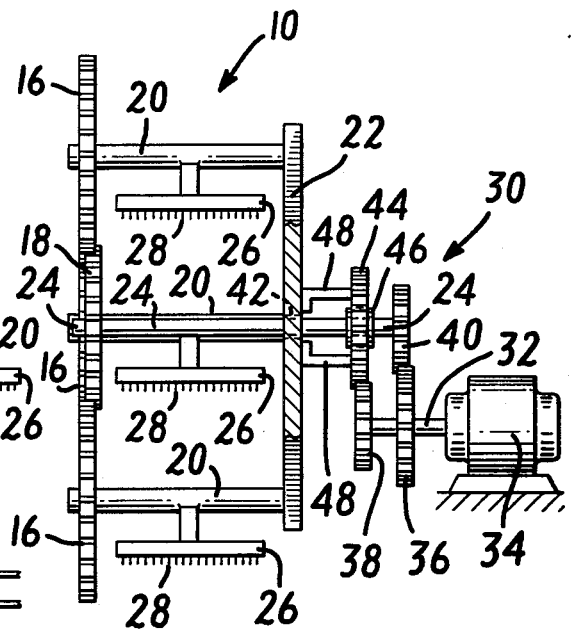
FIG. 2 diagrammatically shows partly in section a side view of FIG. 1 taken along 2—2, also showing the gearing used to assist in driving the embodiment of FIG. 1.

While sun gear 18 and plate 22 are both driven, they may be driven from a common source. Referring to FIG. 2, a drive system 30 is shown. Shaft 32 is rigidly connected to motor 34, to gear 36 and to gear 38. Operation of motor 34 rotates shaft 32 and gears 36 and 38. Gear 40 is positioned to mesh with gear 36, the gear diameter ratio (gear 36 to gear 38) being 3 to 2. Rigidly connected to gear 40 is shaft 24 which passes through and extends past gear 44 by means of bearing 46 and through plate 22 by means of aperture 42. Gear 44 is positioned to mesh with gear 38, the gear diameter ratio (gear 44 to gear 38) being 3 to 2. Gear 44 and shaft 24 rotate independent of each other by virtue of bearing 46. L-shaped brackets 48 secure gear 44 to plate 22. Plate 22 will thus rotate at the same angular speed as gear 44. Sun gear 18 is secured to the free end of shaft 24 to rotate therewith, as described hereinbefore. Shaft 24 rotates at 3/2 the speed of shaft 32 while gear 44 rotates at $\frac{2}{3}$ the speed of shaft 32. Accordingly, shaft 24 rotates at 9/4 the speed of gear 44 for the sun gear to planet gear angular speed ratio of 2.25 to 1.

Figure 3:
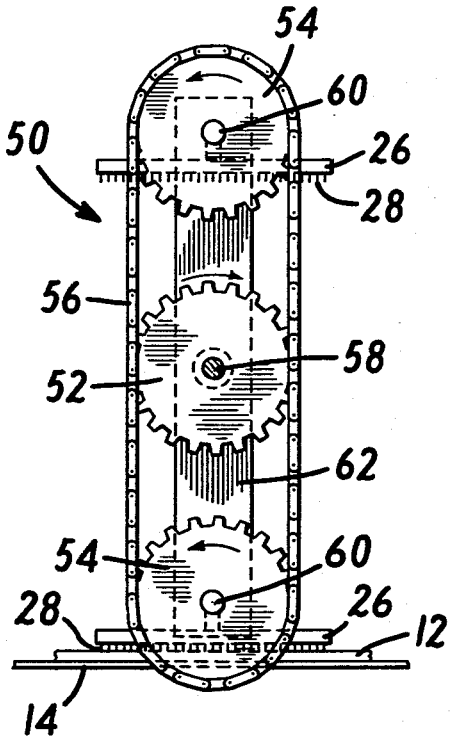
FIG. 3 diagrammatically shows an end view of another embodiment of the invention.
Figure 4:
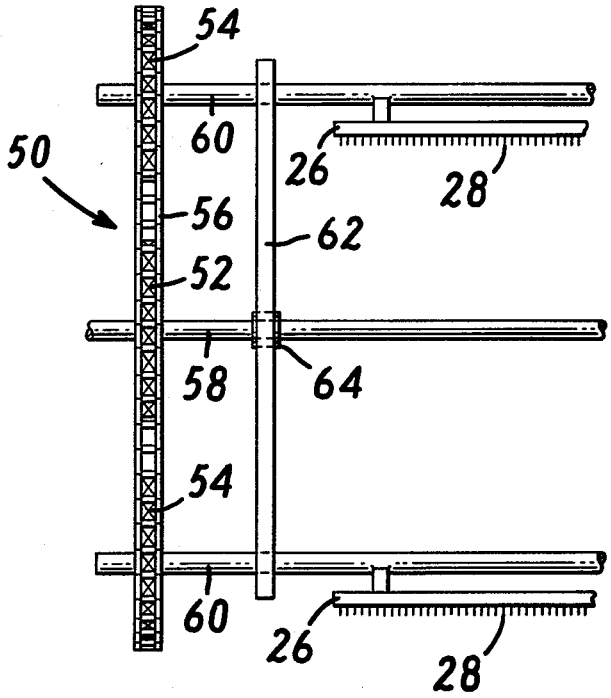
FIG. 4 shows a side view of the embodiment of FIG. 3.

Referring to FIGS. 3 and 4, another embodiment of the invention using a chain and sprocket arrangement 50 is shown. Center sprocket 52 and planet sprockets 54 are interconnected by chain 56. Shaft 58 is rigidly connected to sprocket 52 and shafts 60 are rigidly connected to respective sprockets 54. Shafts 60 are also interconnected by connection to plate 62. Shaft 58 is stationary. Rotation of plate 62 about shaft 58 by suitable means (not shown) causes chain 56 to move along fixed sprocket 52 and rotate sprockets 54 about respective shafts 60 in the opposite direction from the direction of movement of plate 64. Shaft 58 passes through plate 62 by means of bearing 64 so that plate 62 can rotate about shaft 58. Similar bearings (not shown) are also used between plate 62 and shafts 60 to permit relative rotation between the shafts and the plate. Base plates 26 having pins 28 extending therefrom are rigidly secured to respective shafts 60. Rotation and translational movement of shafts 60 causes plates 26 to move therewith and always remain in horizontal alignment. System 50 is aligned so that pins 28 extend normal to the top surface of board 12. As plate 62 is rotated, sprockets 54 are rotated in the opposite direction. The 1:1 gearing between fixed sprocket 52 and moving sprockets 54 insures that the pins 28 remain normal to the top surface of board 12 as the plates 26 are rotated.

In operation, boards 12 are continuously moved in a first direction in a first plane at a first speed and plates 26 with pins 28 extending therefrom are moved in a second plane normal to the first plane simultaneously, rotationally about the axis of shaft 60 and translaterally about the axis of shaft 58 but in opposite angular directions such that the pins are always normal to the board, the respective axes being positioned such that the arc of the plates 62 about shaft 58 contacts the boards at a tangent thereto, the speed of the boards and plate along the tangent being approximately equal. As plates 26 rotate, pins 28 extending therefrom successively contact the moving boards and punch holes therein. Since the pins are moving at approximately the same speed as the boards when they are in contact, and since the pins are normal to the board during the time of contact, the punched holes have no or negligible elongation.

While system 50 has been shown utilizing only two base plates 64, it will be understood that the number of base plates is not limited to two. Four, six or more base plates may be utilized as long as the respective shafts thereof are equally distant from center shaft 58. In such an arrangement, the center sprocket may be offset from the planet sprockets.

Figure 5:
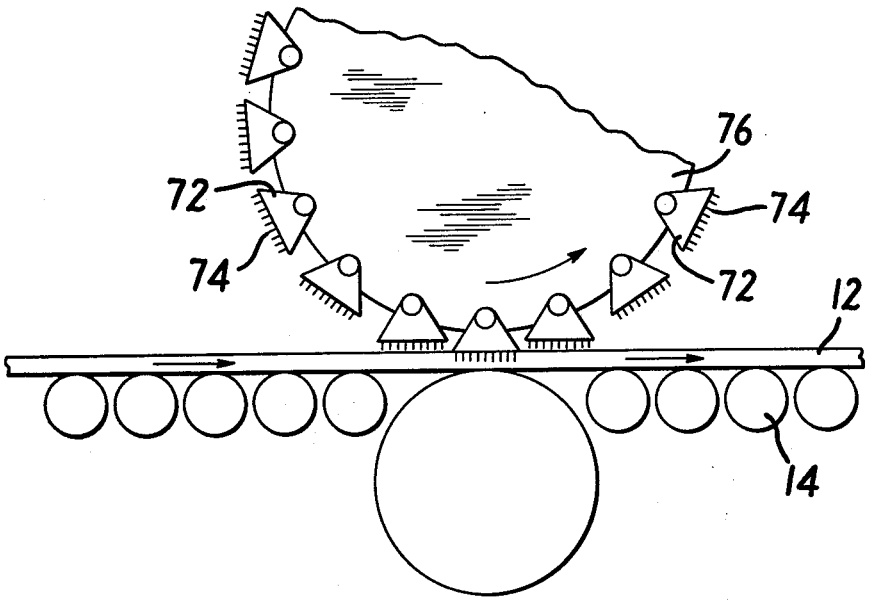
FIG. 5 diagrammatically shows a view of an alternative embodiment according to the present invention.

FIG. 5 shows an alternative embodiment wherein a series of bars 72 carrying acoustical pins 74 are located around a driven roll 76. The bars are counter weighted to contact the surface at a parallel angle. As with the mechanically synchronized embodiment hereinbefore discussed, this permits deep, straight-in punching with a minimum resistance to withdrawal as well as a minumum of hole-pattern elongation.

Figure 6:
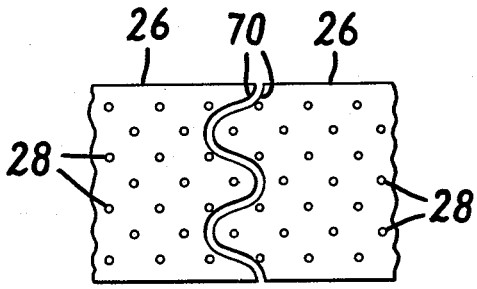
FIG. 6 shows a detail of a portion of irregular edged plates from which hole punching pins extend.

The horizontal spacing between rotating base plates in all embodiments in dependent upon the physical size of the system itself, the sun gear, sprocket shaft or driven roll size and the desired depth of penetration of the pins. A spacing of only $\frac{3}{8}$ inches is realizable. To avoid unpunched strips in the boards the base edges 70 can be made saw-toothed so that portions of each plate overlap each other as shown in FIG. 6.

The invention disclosed herein seeks to equalize the speeds of the pins and the boards during contact and to maintain the pins in a predetermined orientation (normal) to the boards during contact. Since the pins move about an arc and the boards move in a line, the speeds of each will not be precisely equal during their entire period of contact. The boards move at a linear horizontal velocity vh. The linear horizontal velocity of the pins equals the linear velocity v of the pins times the cosine of the angle ($\theta$) that the arc of the pins forms with the horizontal ($vh = v \cos \theta$). Accordingly, when the angle formed by the arc and the horizontal is 0°, then $vh = v$, and the linear speeds of the pins and boards are precisely equal. However, satisfactory results with a minumum of elongation in the holes have been achieved when contact between the pins and the boards is made when the angle between the arc and the boards is less than 30°. The cosine of 30° is 0.866. Therefore, the linear speed of the pins is never less than 0.866 of the horizontal speed of the boards during the time they are in contact, while the pins are always normal to the boards during their time of contact.

While the embodiment of FIG. 1 has been illustrated with four planet gears, it is understood that fewer or more planet gears may be utilized in accordance with the invention.

The invention disclosed herein illustrates only three embodiments for equalizing the speeds of the boards and hole punching means during contact and for maintaining the hole punching menas in a predetermined orientation with respect to the boards during contact. It is intended that the claims encompass other apparatus which will be made apparent to those skilled in the art by the disclosure herein. For example, the embodiments disclosed for the purposes of illustration employ rotary motion which is smooth and relatively easy to accomplish and control. However, other motion may be employed in accordance with the invention.

The advantages of the present invention, as well as certain changes and modifications of the disclosed embodiments thereof, will be readily apparent to those skilled in the art. It is the applicants' intention to cover by their claims all those changes and modifications which could be made to the embodiments of the invention herein chosen for the purposes of the disclosure without departing from the spirit and scope of the invention.

What is claimed is:

1. Apparatus for punching holes in continuously moving board material comprising:

(a) means for continuously moving the board material in a linear direction at a predetermined speed;

(b) a plurality of hole punching means each of which has a plurality of pin-like projections extending therefrom;

(c) a plurality of toothed gear wheels each of which is capable of movement in a plane perpendicular to the surface of board material;

(d) each said hole punching means being rigidly positioned with respect to a toothed gear wheel and being aligned with the pin-like projections in substantially perpendicular relationship to the surface of the board whereby the pin-like projections are at all times rigidly positioned in a direction normal to said board surface;

(e) means for moving the hole punching means and pin-like projections through a circle which has as a tangent the said linear direction, the means for moving including at least one toothed drive wheel which positively drives each said toothed gear wheel being operative to move the pin-like projections at and along at least a portion of the tangent to contact the board material at an angular speed such that the linear speed of the pin-like projections and the said predetermined speed are approximately equal during the time in which the pin-like projections and the board material are in contact; and (f) said means for moving the hole punching means and pin-like projections also being operative to maintain said pin-like projections in said substantially perpendicular relationship throughout the movement through said circle.

2. The apparatus of claim 1 wherein said toothed gear wheels are planet gears which mesh with said toothed drive wheel which is a sun gear.

3. The apparatus of claim 2 wherein there are four planet gears.

4. The apparatus of claim 1 wherein said toothed gear wheels are spaced from said toothed drive wheel and are positively driven by a chain which engages the teeth of said toothed gear wheels and the teeth of said toothed drive wheel.

5. The apparatus of claim 1 wherein each said toothed gear wheel is fixedly mounted on a gear shaft and each said hole punching means is fixedly mounted on a gear shaft.

* * * * *